United States Patent [19]

Boczkiewicz

[11] Patent Number: 5,042,515

[45] Date of Patent: Aug. 27, 1991

[54] OPERATOR PROTECTION FOR HIGH PRESSURE HOSE MACHINES

[75] Inventor: Bruce M. Boczkiewicz, Mukwonago, Wis.

[73] Assignee: Super Products Corporation, Mukwonago, Wis.

[21] Appl. No.: 528,688

[22] Filed: May 24, 1990

[51] Int. Cl.[5] ..... B08B 9/02

[52] U.S. Cl. ..... 134/167 C; 137/355.12

[58] Field of Search ..... 134/166 C, 167 C, 168 C, 134/169 C, 172, 180, 199; 15/302, 315, 414; 137/355.12; 239/169, 175

[56] References Cited

U.S. PATENT DOCUMENTS 4,944,258 7/1990 Knutson et al. ..... 134/167 C

*Primary Examiner*—Philip R. Coe

*Attorney, Agent, or Firm*—Foley & Lardner

[57] ABSTRACT

A device for use in connection with the operation of high pressure equipment, such as a sewer and/or catch basin cleaner which has a hose reel for the water hose, and includes a protective shield which can be located in at least two positions. A first position is an operator protection position used when the machine is pumping fluid. A second position is a position in which access may be had to a hose reel or other machine components. An interlock coupled to the shield prevents high pressure fluid from being passed through the hose when the enclosure is in its second position. The shield of the present invention can be used in conjunction with a second, flexible tubular sleeve to provide head-to-toe protection for the operator of such equipment.

11 Claims, 4 Drawing Sheets

OPERATOR PROTECTION FOR HIGH PRESSURE HOSE MACHINES

BACKGROUND OF THE INVENTION

1. Field of the Invention

The present invention relates generally to the field of preventing injury to the operators of machinery which includes a hose through which fluid is pumped under high pressure. More specifically, and in the preferred e embodiment, the invention relates to the protection of operators of high pressure and high velocity sewer cleaning equipment which uses water jeeting of the cleaning of sewer laterals.

2. Description of the Prior Art

Several types of sewer and catch basin cleaning machines are available on the market. Two types of such machines are manufactured by the assignee of the present invention, including the CAMEL® machines (which include sewer and catch basin cleaning compounds and the "CAMEL JET" ® machines which are principally used for sewer cleaning without catch basin vacuuming.

In both types of machines, a hose reel is provided for containing up to 800 feet or more of a hose through which water is pumped at high pressure during the sewer cleaning operation. Pressures as high as 2500 psi or more are utilized with a jetting nozzle having reverse nozzle openings which, in effect, drive the nozzle into the sewer lateral pulling hose behind. The nozzles create a cutting a nd loosening action within the sewer laterals also that debris is loosened and carried by water flow to a catch basin or manhole. In those machines which include vacuum systems, a vacuumhose supported by a hydraulic boom, removes material, including material ial loosened from the laterals, into a debris tank on the truck A machine of this nature is disclosed in the Wurster, et al U.S. Letters Pat. No. 4,134,174 entitled "Sewer And Catch Basin Cleaner", issued on Jan. 16, 1979. This patent also discloses machines which include water filtration systems to allow purification of the water collected in the debris tank for subsequent reuse in the water jetting operation The hose reel in the aforementioned type of equipment may be mounted within an open area behind the truck cab or in front of the truck, depending on the desired end use for the machine In both cases, the hose reels are hydraulically driven to wind the hose onto the reel after the jetting forces have unwound the hose. Pulling the hose against the pressure of the jetting nozzle adds to the effectiveness of the lateral cleaning operation Another type of machine is the "CAMEL JET" machine which does not include the vacuum system, but does include the hose reel and high pressure jetting equipment described above In this particular machine, the hose reel is mounted with its axis perpendicular to the axis of the truck and aligned so that the hose is unwound at the rear of the truck or trailer body. It should be understood that the reel may also be positioned in front of the chassis if desired A lever, known as a level winder, is provided for steering the hose during rewinding to prevent the hose wraps from snarling on the reel and further to assist in aligning the hose with the entrance to a catch basin or manhole and into a sewer:lateral.

One of the significant problems associated with the use of this type of equipment is the potential for operator injury in the event the high pressure hose or its coupling were to burst or come loose during use. Concerning the latter situation, newly supplied hoses are continuous, without interruption throughout their However, it is a common practice to utilize repair couplings in areas where a hose becomes abraded or is cut or otherwise damaged The hoses are repaired by severing to remove the damaged area and are reconnected with the use of repair couplings An operator should advantageously stand relatively close to the reel and catch basin or manhole for normal operation, because he must look into the manhole for guiding the hose into the sewer lateral. Visibility into the catch basin or manhole is particularly vital during the initial set up and during retrieval of the high pressure hose. The safety problem arises if the hose were to burst or a coupling were to fail at the area between the hose reel and the location where the hose enters the manhole. Here, the end of the hose can fly wildly about under the high water pressure, creating risk of injury.

The general problem has been recognized since at least 1984 by the assignee of the present invention, and as illustrated in one of its brochures published about that time, a transparent shield was provided around the upper one-quarter of the hose reel in the general vicinity of where an operator would stand.

Other types of high velocity sewer flushing machines are made by Sreco as described in its product bulletins 3000 and 3045. The latter product bulletin describes the SAFE-WAY® machine, which includes a cabinet extending from the gear of the truck in the vicinity of the hose reel. The cabinet includes components which are assembled on site for each job, and a clear shatterproof view window is included so that the hose can be seen from the control panel area. The cabinet is spaced above the roadway so that the hose can be seen below the level of the cabinet, several inches above the manhole rim. The device is relatively cumbersome to use, and the need to disassemble and reassemble the cabinet presents a serious obstacle to machine efficiency The Sreco machines must be used on a relatively level surface and little or no room is available for entry of a vacuum hose. It is necessary to use mirrors (not shown in the product bulletins) to see into the manhole and during operation the pressure hose may be located very close to the operator with a portion exposed between the lowermost part of the shield and the street level Another device providing shielding for a portion of a high pressure hose is shown in an advertisement of Underground, Inc. A catch basin or manhole cleaner is supported by a mobile trailer While protection is provided near the reel, no protection is provided between the lowermost marginal edge of the shielding housing and the catch basin or manhole.

A containment system which would prevent operator injury and permit hose manipulation and easy access to the hose reel and which otherwise overcomes the shortcomings of the devices of the prior art would represent a significant advance in this technology.

In co-pending, commonly assigned U.S. Pat. application Ser. No. 07/340,899 filed on Apr. 17, 1989, and now Pat. No. 4,944,258, an operator protection system which overcomes some of these problems is described. The system disclosed in such application includes an upper, hood-like shield substantially enclosing the hose reel. A flexible, tubular second enclosure extends from within the first enclosure down into the manhole. The hose is passed through the tubular enclosure into the lateral and is guided by the operator in a conventional manner. Head-to-toe protection is provided by this system if properly used.

Several problems remain with regard to the efficient use of operator protection systems as exemplified by the earlier application, namely, methods to ensure the use of the system as furnished by the manufacturer and gaining access to the hose reel or other internal components of the machine in a safe manner. To expedite operation of the machinery described in the commonly-owned application, the operator could, contrary to the instructions provided with the equipment, raise the first enclosure to gain access to the internal mechanisms or hose reel and turn on the machinery whereby water would be forced under high pressure through the hose. Furthermore, it is somewhat cumbersome with the prior device to gain access, while the machinery is shut down, to the hose wrappings or to insert the sewer jetting nozzle into a containment tube or into a water recirculation system if such is provided The latter system is one in which fluid is circulated continually through the water tank and hoses in cold weather to prevent freezing thereof An invention which overcomes these situations would represent yet another significant advance in this technology.

SUMMARY OF THE INVENTION

The present invention provides an operator protection system which includes a shield which is slidably mounted or hinged to permit access to internal machinery components and which includes a lock-out feature to prevent water pumping through the hose reel during access periods.

The present invention also provides an operator protection shield which may be stored during movement of the machine from job site to job site.

The present invention also provides an operator protection system which includes mechanical interlocks, since the equipment is typically used in environments involving water, causing potential electrical hazards How the present invention provides these benefits will be described by reference to the following detailed description of the preferred embodiment, taken in conjunction with the drawings Generally, however, the system is similar to that of the aforementioned U.S. application No. 07/340,899, but the mounting of the upper shield is significantly different. In one embodiment, the shield will have approximately two (2) feet of upward mobility and can be locked into an upper position in which access is easily provided to the components normally shielded, including the hose reel. A mechanical interlock is provided, so that when the shield is in the upper position, intentional or accidental operation of the high pressure valve is prevented. The shield, in this embodiment, may also be mounted in such a way that it may be stored in a travel position when the machine is being taken from job site to job site or is otherwise not in use. Finally, a third position for the shield is provided in which it is in a lower or operating position, which when combined with a tubular enclosure as described in the aforementioned pending application, provides head-to-toe operator protection. In another embodiment, the shield may be hinged for pivotal movement between reel access and operating positions, with the lock-out system preventing operation of the high pressure valve when the shield is in the access position. Other ways in which the invention can be constructed will become readily apparent to those skilled in the art after reading this specification Such ways are also deemed to fall within the scope of the present invention if they, or their equivalents, fall within the scope of the claims which are appended hereto.

DESCRIPTION OF THE PREFERRED EMBODIMENT

Figure 1:
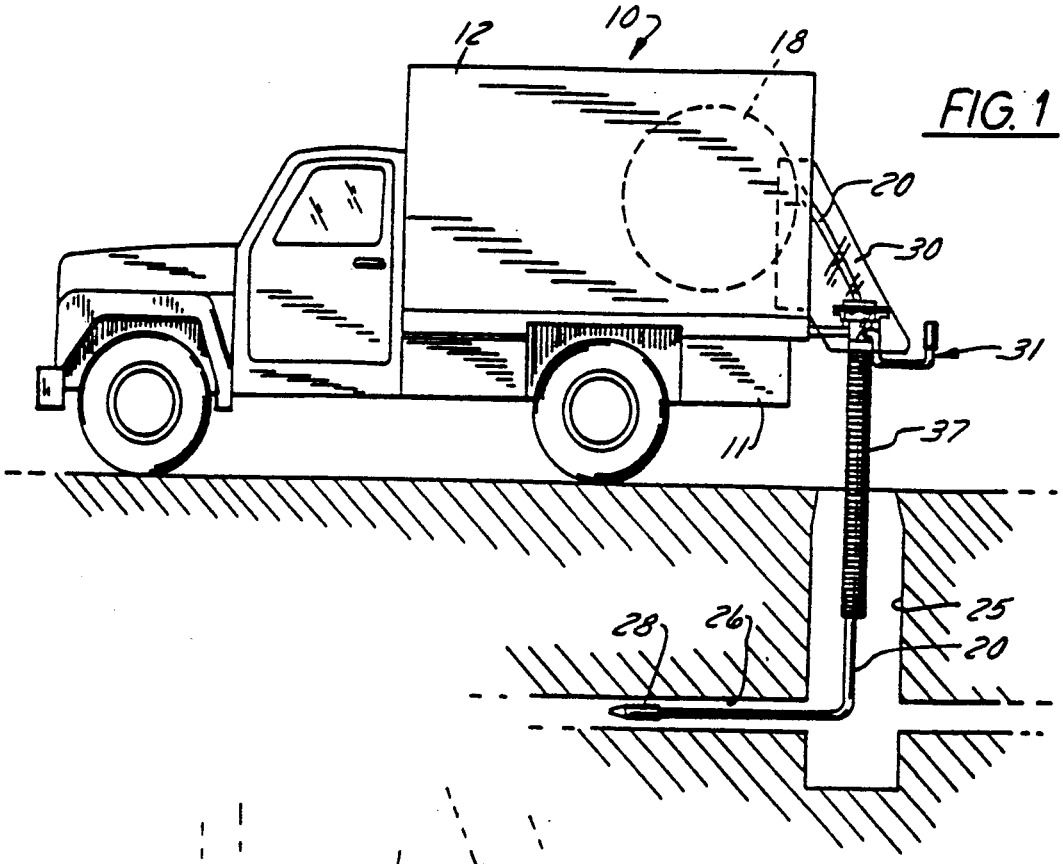
FIG. 1 is a side elevational view of a sewer cleaner mounted on a truck according to a preferred embodiment of the present invention.

With reference to FIG. 1, there is disclosed a sewer and catch basin cleaner 10 which may be mounted on the chassis of truck 11, but it should be noted that the cleaner 10 may also be mounted on a trailer. It may be skid mounted, or it could be self-propelled, e.g. on a crawler tractor (not shown) Because of these various modifications, the description of the present invention in connection with truck mounting should be taken as illustrative, rather than limiting.

With reference to FIG. 1, the cleaner 10 includes a water tank 12, which is preferably constructed from rib-reinforced sheet steel so that it can withstand loading with water, a water pump (not shown) and a hose reel 18 with a water hose 20 coiled on and supported by the reel 18.

The cleaner 10 may also include a material collection body (not shown). For purposes of simplicity in drawing and in description, the usual vacuum intake or collection hose has not been shown. Details of a typical cleaner in which the invention may be incorporated are disclosed in the aforementioned Pat. No. 4,134,174, which disclosure is incorporated herein, in its entirety, by this reference.

The hose 20, which is capable of withstanding high pressure exerted by the water pump, is inserted into a sewer manhole or catch basin 25, and from there into a sewer lateral 26 to be cleaned. Water forced through the hose 20 under high pressure and outwardly of a nozzle 28 will drive the nozzle 28 into the lateral 26. Because of rearwardly operating jets (not specifically shown), the nozzle created forces will pull the hose 20 from the reel 18. The reel 18, if desired, may include drive means (not shown) for feeding and rewinding the hose 20 into the lateral 26 at a controlled rate.

As stated above, this invention provides operator protection because of the high pressure associated with application of water through the pressurized water hose 20. This is partially accomplished by providing a hood-like, transparent, shatterproof shield 30 adapted to generally surround the area of the hose reel 18 to which the operator might be exposed during normal operation of the sewer cleaning machine 10. The shield 30 is slidably supported on cleaner 10 and is in an operating position in FIG. 2. The shield 30 is preferably open at the side towards the reel and at its bottom, with sufficient room within the shield to accommodate a level winding device 31 adapted to swing horizontally from one side to the other to permit the hose to be rewound on the reel, with the wraps being disposed adjacent to one another, without lying across one another.

With reference to FIGS. 2-6, inclusive, the details of the protective device of the invention comprise an enclosure shield 30, preferably formed of a high strength, shatterproof transparent material such as Lexan plastic manufacted by General Electric Company. Transparency is desirable so the operator can visibly observe the rewinding of the hose 20 on the reel 18 while operating the level winder 31. The shield 30 is generally formed as a "hood" or "shroud" for substantially protecting the operator from rupture of the hose 20, as will hereinafter be described. In general, the shield 30 includes a front face 32, parallel side faces 33, with the side faces being substantially triangular to permit ease in moving the shield within the access opening 35 in the rear of the truck 11. The side of shield 30 facing inwardly is open to partially receive the flanges of the reel 18. The bottom of the shield 30 is open to provide access to the level winder 31, and for ease in placement of the hose within the lower protective portion which is the subject of the aforementioned earlier application Ser. No. 07/340,899. This shield arrangement permits full vision of the hose reel and hose, as well as an easy view, without glare, into the manhole The present invention will be illustrated for use with a protective sleeve 37, but the major features of the present invention relate to the mounting of shield 30 and the lock-out features shown therewith A protective sleeve 37 is arranged to cover the exposed length of the high pressure hose 20 by extending a significant length inwardly of the shield 30 and also into the mouth or entrance of catch basin 25 to provide protection of the lower extremities of the operator.

Figure 2:
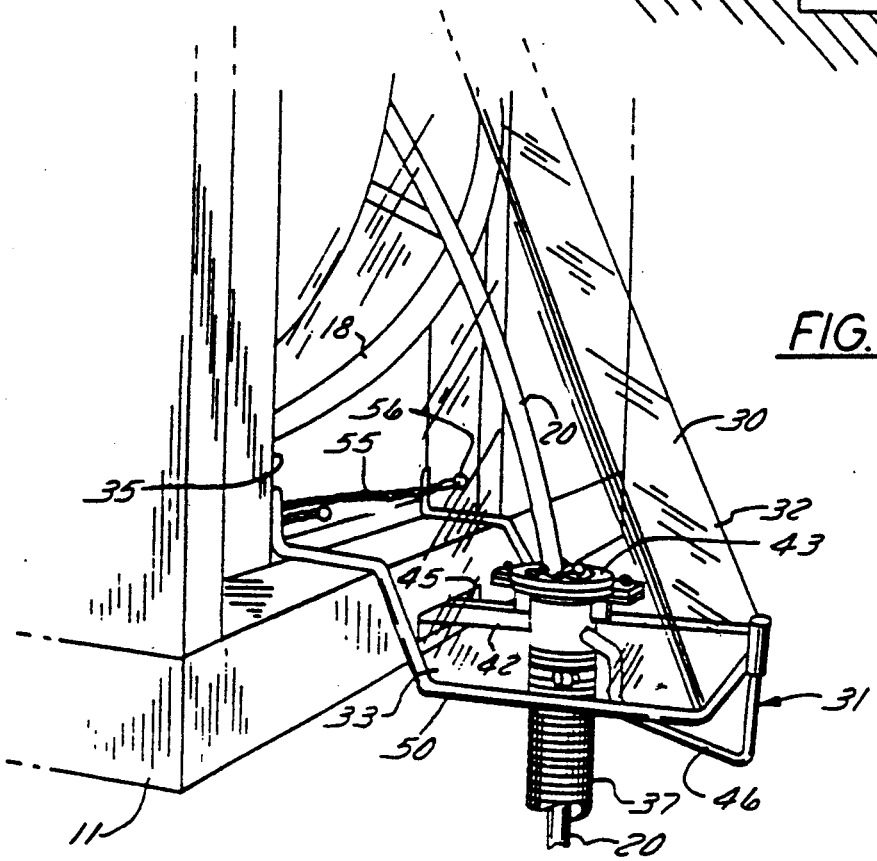
FIG. 2 is a fragmentary perspective view of the rear portion of the cleaner of FIG. 1.

The lower protective portion with which the shield of this invention is preferably used generally comprises an elongate, tough flexible conduit member 37 having a smooth bore of sufficient diameter or shape to freely and slidably receive the pressurized water hose 20. The sleeve 37 has its upper end extending inwardly of the transparent shield 30 as shown in FIG. 2 and may be, as shown, supported by and moveable with the level winder 31. The protective sleeve 37 is supported at the outer end of a winder operating arm 42 extending through an aperture 45 of the truck body 11. The winder arm 42, is supported from a pivot support (not shown) located inwardly of the truck body 11. The level winder 31 is not always required, but it will be noted that the protective device of the present invention will accommodate a winder 31, as shown, and its pivotal swing from side to side. This arrangement permits the level winder arm 42 to be moved from side to side in a horizontal plane to that the hose 20 is rewound on the reel with no cross-over of adjacent coils or wraps.

The hose 20 may then pass through, for example, a four-way roller plate and collar device 43 supported at the lower end of the winder arm 42 from which extends an operating handle 46. The handle 46 is preferably L-shaped to extend upwardly and outwardly of the shield 30. The protective sleeve 37 may be made of a wire supported, single ply nylon fabric reinforcement having a rubber cover and a rubber liner, such as the Type MH TUFTEX series tubing manufactured by Termoid, Inc. of Chanute, Kansas.

With particular reference to FIG. 2, it will be observed that the shield 30 may be provided with a grooved vinyl channel 50 for protecting the lower marginal edge of shield 30. Utility chains 55 are fastened at both sides 33 of the shield 30 by means of attachment pins 56. The opposite ends of each chain 55 are fastened to a stationary channel-shaped member 57 (see FIG. 3). These chains 55 assist in holding the shield 30 in place and provide additional protection to the operator if a hose or coupling were to break inside shield 30. Pivotal rotation of shield 30 about the axis of pins 52 could occur under such a condition. Utility chains 55 are shown for example only and may be replaced with other linkages, cables, etc.

Figure 7:
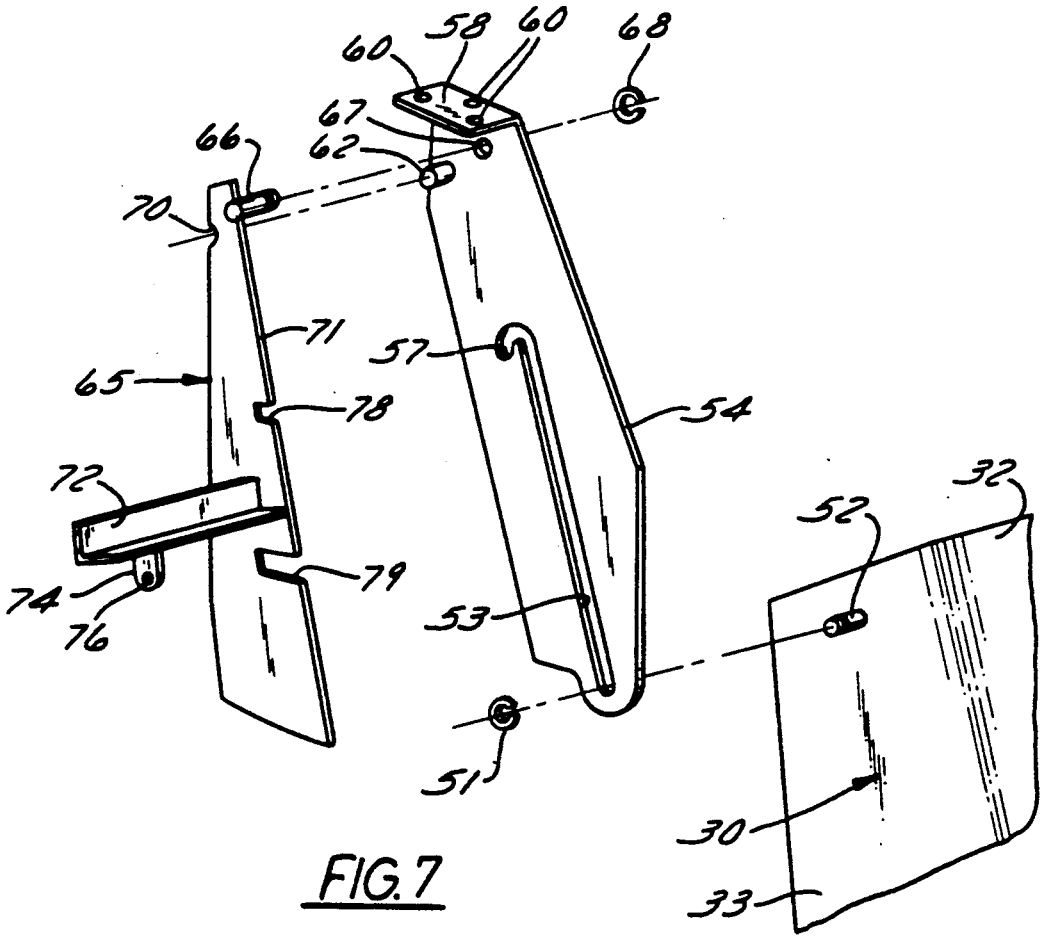
FIG. 7 is an exploded perspective of a portion of the shield, mounting bracket and lock out plate components ponents of this preferred embodiment of the present invention.

As best seen in FIG. 7, shield 30 is provided, at its upper end, with coaxial attaching pins 52 secured to both side faces 33 thereof. The pins 52 are adapted to ride in a pair of grooves 53 formed in oppositely disposed stationary brackets 54 extending As will be observed from FIGS. 3 and 7 each slot or groove 53 is generally linear for guiding shield 30 from the operating position shown in FIGS. 2 and 3 to the storage position shown in FIG. 4 and to the upper positions shown in FIG. 5. A rearwardly directed bend 57 is located at the top of groove 53. Bend 57 allows seating of pins 52 and restraint of shield 30 after it has been raised and urged gently forwardly. Pins 52 include a groove at their distal ends to accomodate a snap ring 51, or other suitable retainer device, after the pin has been received in and passes through grooves 53.

The mounting of shield 30 can further be understood by reference to FIG. 7 where one of the brackets 54 is shown to include a top plate 58 perpendicular to the remainder of plate 54, holes 60 being provided therein for mounting the plate in the access opening of the cleaner truck. A hole 67 is provided near the top of bracket 54 and a peg 62 is provided adjacent thereto for purposes which will soon become apparent.

In the preferred embodiment of the present invention, an elongate, rotatable plate 65 is mounted for pivotal rotation about the axis of hole 67, plate 65 being parallel and generally adjacent to plate 54 when the components are assembled. A pin 66 is affixed to the top of plate 65, which pin passes through holes 67. A snap ring 68 loosely connects the two plates. A semi-circular indentation 70 is formed in the upper portion of plate 65 to cooperate with pin 62 on plate 54 to provide a locking system for preventing clockwise rotation of plate 65 about the axis of pin 66 by more than a limited degree of rotation. As will soon be shown, plate 65 is rotated rearwardly by the handle used to operate the high pressure valve.

The plates 65 and 54 are arranged in such a manner that the front edge 71 of plate 65 is generally parallel but to the rear of groove 53 when the ball valve 86 is in a closed position and indentation 70 rests against stop pin 62. Rotation of plate 65 rearwardly (with respect to the truck) will result in groove 53 being covered by the body of plate 65. In the FIGURES, rearward rotation is counterclockwise while forward rotation is clockwise.

Extending outwardly from the surface of plates 65 are angle irons 72 to which are mounted, at their distal ends, a descending small plate 74 having an aperature 76 therein. As will be seen in a description of other drawings, this plate serves as the coupling member for the lock-out mechanism used in the preferred embodiment of the present invention.

The final features apparent in FIG. 7 are a pair of slots 78 and 79 cut into the rearwardly facing edge 71 of plate 65 at heights determined by the location selected for the upper and intermediate positions of shield 30. The upper slot 78 is provided so that pin 52 may reside therein when it is in bend 57 and with plate 65 rotated forwardly and abutting pin 62. Rearward rotation of plate 65 while the pin is residing within slot 79 is impossible.

Figure 3:
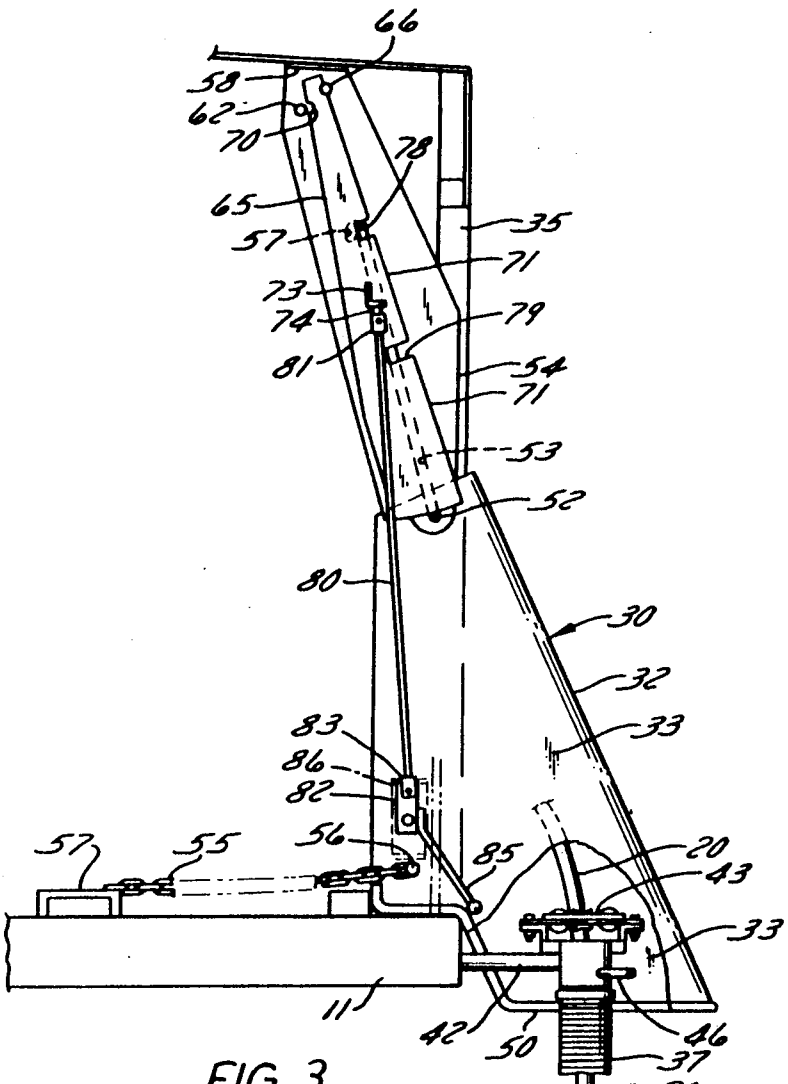
FIG. 3 is a fragmentary side elevational view of the protective device of one preferred embodiment of the present invention, with the back end portions of the water hose removed for clarity in assisting description and showing the shield in the operating position.

Proceeding next to a description of FIG. 3, shield 30 is shown in its operating position with pin 52 residing at the bottom of groove 53 and plate 65 rotated rearwardly so that pin 52 is prevented from upward travel in groove 53. This FIGURE also illustrates a coupling rod 80 extending between bracket 76 and a control plate 82 of a valve operating member to be described later. A clevice 81 provides pivotal coupling of the rod at the upper end, while a clevice 83 is provided at the lower end of the lock-out assembly. FIG. 3 also shows an operating handle 85 for a valve member 86 (shown in general form only) and shows the handle in a lowered position indicating that water is free to be pumped through hose 20 by the high pressure pump (not shown) The handle in its elevated position would indicate the off position for high pressure pumping to the hose. Through the coupling rod 80, movement of handle 85 to the position shown in FIG. 3 causes the rearward rotation of plate 65. That is, when down, the plate is rotated rearwardly, while when the handle 85 is in the up position plate 65 is rotated forwardly, exposing groove 53.

Figure 4:
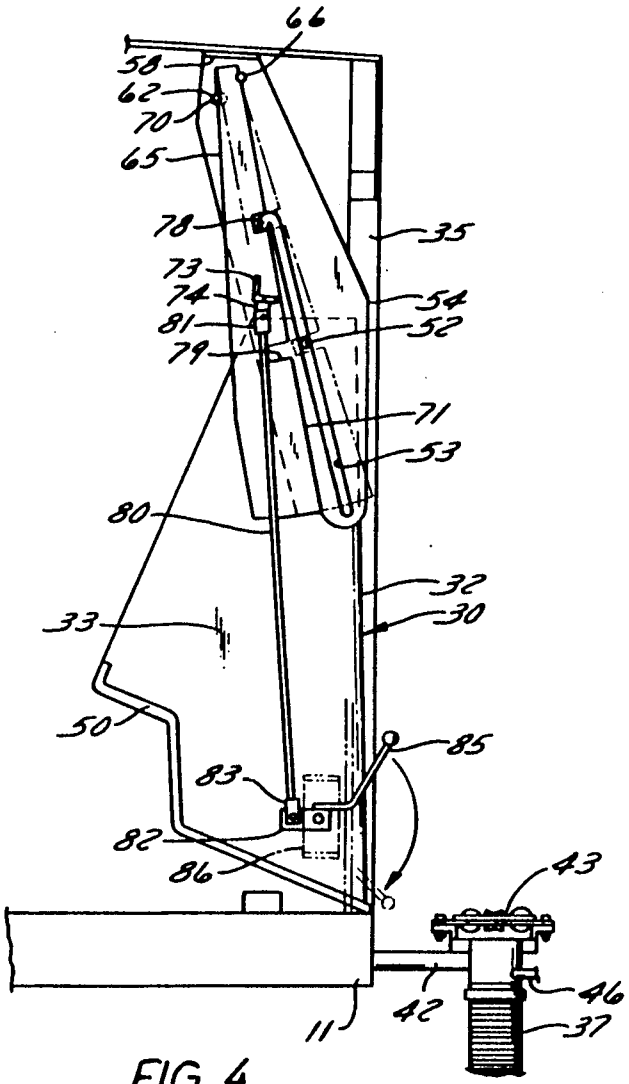
FIG. 4 is a fragmentary side elevational view of the protective device of the present invention with the shield of FIG. 3 shown in the storage position

FIG. 4 illustrates the optional intermediate or storage position for shield 30 illustrating how pin 52 has travelled upwardly in groove 53 and is adjacent slot 79 in plate 65. Plate 65 is shown in full line position in its forwardly pivoted position and in dotted line for its rearward pivot location corresponding to the full and dotted line portion of handle 85. In this intermediate position, it may be desirable to permit opening of valve 86, for example if during movement of the truck, water is to be recirculated to avoid freezing in cold climates. The hose end (not shown) would be inserted in a recirculation receptacle at this time.

Figure 5:
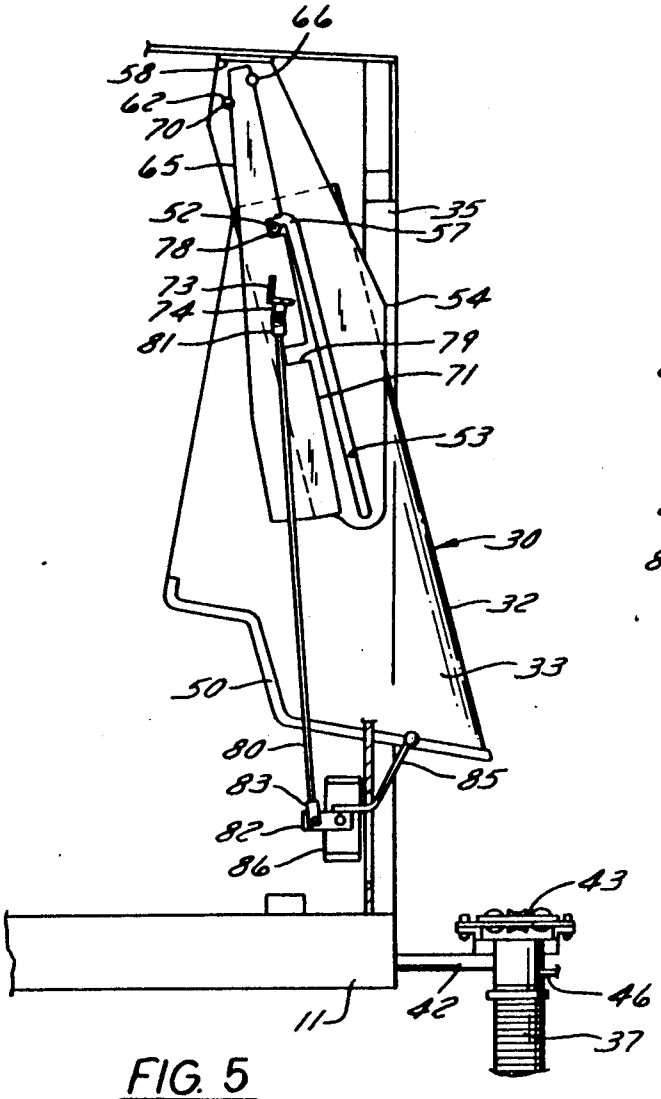
FIG. 5 is a fragmentary side elevational view of the protective device of the present invention, with the shield of FIG. 3 shown in its upper position.

FIG. 5 clearly shows the lock-out capability when the shield is in an upper position, i.e. where pin 52 is located in the top bend 57 of groove 53. Plate 65 must be rotated forwardly for the shield to be manually raised to the top (handle 85 must be up) and urged into bend 57 and the location of the pins in bend 57 will, in all instances prevent lowering of handle 85.

Figure 6:
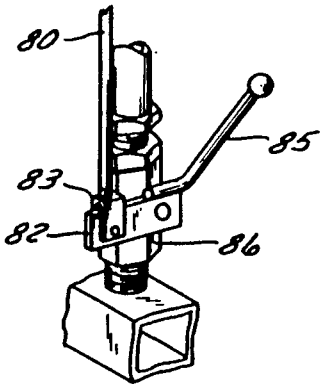
FIG. 6 is a perspective view of the valve arrangement ment used in this embodiment of the invention.

FIG. 6 is a close up view of one form of bracket and valve assembly showing clevice 83, plate 82, valve 86 and handle 85 in the positions they would all assume at the time the lock-out feature of the present invention is being utilized.

In the preferred embodiment of the invention, shield 30 is able to move approximately two feet vertically, giving access to the hose reel and other internal al components of cleaner 10. The operator is protected from either intentional or unintentional activation of valve 86 by the lock-out system depicted in the drawings.

It will be readily appreciated to those skilled in the art that numerous other systems can be employed to prevent a valve from operating when shield 30 is in a position, other than an operating position. The mechanical system illustrated in the preferred embodiment is an excellent system to use with machinery involving water in that it avoids the need for potentially dangerous electrical components or safety devices known for preventing shock under such conditions.

As an example of other ways in which the present invention could be embodied, reference will be made to a hinged shield, which could resemble in overall shape the shield 30, shown in the illustrated embodiment. Such a shield could be mounted to the cleaner along one generally vertical edge, whereby the shield could be pivoted over or away from the hose reel it is adapted to guard. A system would be employed with such a pivotable or hinged shield to positively prevent the water valve from being activated, except when the shield is in its operating or guarding position. One way this has been accomplished on a trailer mounted device is to employ a plate on the rotatable edge opposite from the hinge, the plate including a hole therethrough. The valve cannot be opened unless the plate is fully placed into its shield guarding position, whereby a pin of the valve control element penetrates the hole and permits opening of the valve.

It can be seen from this example, that the principles of the invention can be adapted to a wide variety of shield and shield mounting arrangements. Instead of the three portion shield shown in the FIGURES, a two position shield could readily and usefully employ the teachings of the present invention, as could the hinged type just described Moreover, it should again be emphasized that other position sensing techniques (for example, photo sensors, position sensing hinges, limit switches and the like) could be substituted for the mechanical interlock illustrated.

Numerous other variations can be made by one skilled in the art after reading the foregoing specification. Thus, while the invention has been described in connection with the illustrated preferred embodiment, the invention is not to be limited thereby but is to be limited solely by the claims which follow.

What is claimed is:

1. In a sewer and/or catch basin cleaner of the type including a water injection system comprising a high pressure water hose, reel means supporting said hose and arranged to permit the hose to extend into and be withdrawn from a sewer catch basin or manhole, means for delivering water under pressure and means for protecting an operator from hose or coupling rupture, said protection means including a first shield means at least partially enclosing an exposed section of the water hose, the cleaner including valve means for permitting water to be pumped through said hose and control means for selectively operating said valve means, the improvement comprising:

means for supporting said shield means in a first position to be used during operation of said valve means;

means for supporting said shield means in a second position; and means interacting with said shield means and said valve means for preventing pumping of water through said hose when said shield means is in said second position and to permit pumping of water through said hose when said shield means is in its first position.

2. The cleaner of claim 1 wherein said shield means comprises a transparent shield.

3. The cleaner of claim 1 wherein said shield means is supported by a support means comprising bracket means mounted at opposite sides of an access opening for said hose reel, each bracket means containing a slot configured to slidably receive a pin means supported by and extending from opposite sides of said shield means to slidably support and guide said shield position into and out of its first and second positions, said slot also including a bend to retain said shield when it is in its second position.

4. The cleaner of claim 3 wherein the lower end of said shield means is loosely coupled to said cleaner by chain means, a first end of which is coupled to said cleaner and the second end of which is coupled to a lower portion of said shield means.

5. The cleaner of claim 3 in which a mechanical lock-out means is provided when said shield means is in its second position.

6. The cleaner of claim 5 wherein said valve means comprises a ball valve means having a handle coupled thereto and said lock-out means comprises an elongate means extending between said lock-out means and said ball valve.

7. The cleaner of claim 6 wherein a rotatable plate means is provided as said lock-out means and is coupled to said elongate means, said plate means preventing movement of said pin means within said slot means when said handle is in a first position and permitting movement of said pin means within said slot means when said handle is in a second position.

8. The cleaner of claim 1 wherein said shield means comprises a hood-like shield having at least three adjoining side wall and an open bottom, and defining an open side facing said hose reel wherein said hood-like shield is pivotally supported for movement between said first and second positions.

9. The cleaner of claim 8 wherein the hood-like shield portion is transparent.

10. An operator protection system for use with equipment which includes a hose through which water is pumped under high pressure, said hose being contained on a reel, at least a portion of said reel being open toward an operator of such equipment during use, said system comprising transparent shield means for enclosing at least a portion of said hose, said shield means being movable between an operating position and a a storage position and an upper reel access position, a valve for controlling the pumping of water through said hose and means for operating said valve, and means for preventing operation of said valve when said shield is in its access position and permitting opening said valve when said shield is in its operating position.

11. The system of claim 10 wherein said preventing and permitting means comprises a mechanical interlock system.

* * * * *